United States Patent [19]

Färber

[11] Patent Number: 4,795,086

[45] Date of Patent: Jan. 3, 1989

[54] GABLE-TOPPED CONTAINER

[75] Inventor: Jürgen Färber, Kaarst, Fed. Rep. of Germany

[73] Assignee: PKL Verpackungssysteme GmbH, Dusseldorf, Fed. Rep. of Germany

[21] Appl. No.: 58,455

[22] Filed: Jun. 5, 1987

[30] Foreign Application Priority Data

Jun. 9, 1986 [DE] Fed. Rep. of Germany ..... 3619407

[51] Int. Cl.[4] ..... B65D 5/06; B65D 5/08

[52] U.S. Cl. ..... 229/137; 229/48 T; 229/920; 493/59; 493/160; 493/183

[58] Field of Search ..... 229/17 R, 176, 137, 229/138, 48 T, 48 SA, 48 SC, 920; 493/59, 160, 183, 184, 397, 405, 453

[56] References Cited

U.S. PATENT DOCUMENTS 3,750,932 8/1973 Ellison ..... 229/138
4,267,957 5/1981 Holmström ..... 229/17 R
4,520,957 6/1985 Lisiecki ..... 229/17 R
4,546,915 10/1985 Lisiecki ..... 229/17 G
4,588,122 5/1986 Lisiecki ..... 229/17 R

*Primary Examiner*—Stephen Marcus
*Assistant Examiner*—Gary E. Elkins
*Attorney, Agent, or Firm*—Sprung Horn Kramer & Woods

[57] ABSTRACT

A parallelepipedal gable-topped bulk-material container made out of a multilayer plastic laminate and with its head sealed by a ridged seam, leaving two superimposed triangular folding tabs at the ends of the seam, whereby each tab is wrapped out and around a straight buckling edge on each side of the container and the container material has longitudinal and transverse or sloping scores for the edges of the body and floor or gable edges. To maintain the integrity of a ridged seam when manufacturing and sealing thick-walled containers in a filling machine and hence eliminate ridged-seam fracture, the container has at least one auxiliary score for each vertical body score in the vicinity of the gable and out of alignment with the body score.

9 Claims, 4 Drawing Sheets

GABLE-TOPPED CONTAINER

BACKGROUND OF THE INVENTION

The present invention relates to a parallel-epipedal gable-topped bulk-material container made out of a multilayer plastic laminate and with its head sealed by a ridged seam, leaving two superimposed triangular folding tabs at the ends of the seam, whereby each tab is wrapped out and around a straight buckling edge on each side of the container and the container material has longitudinal and transverse or sloping scores for the edges of the body and floor or gable edges.

When the superimposed triangular folding tabs of a gable-topped container are wrapped around each transverse lateral buckling edge of the body, so much tension occurs in the outer layers of the ridged seam, which is also wrapped around, that what is called ridged-seam fracture will ensue transversely with respect to the seam. Ridged-seam fracture can be ascribed to some extent to the fibers of the laminate extending in the wrong direction (toward the buckling edge), to the thickness of the laminate (base with bonded-on polyethylene films and in special cases aluminum foil laminated in as an intermediate layer), to the particular sealing method, and to the superimposition of five laminations in the vicinity of the buckling edge.

Even if ridged-seam fracture occurs only on the outside of the container and accordingly does not directly impair its tightness, it is unacceptable because moisture can penetrate into the layers of the laminate over the long term, weakening the overall structure of the seal and of the container itself and eventually eliminating tightness. To prevent ridged-seam fracture or at least confine it within acceptable limits it has previously been necessary to acclimatize the container material (subject it to controlled temperature and humidity) at considerable expenditure to make it supple enough to make a container out of.

Gable-topped packages are made out of pre-scored blanks in a process that involves prefolding all the scoring and returning it to the original state of flatness before finally erecting the container. The prefolding leaves sharp-edged upthrusts along the scoring on the inside of the container, especially in blanks laminated with aluminum. The plastic coating on the blank accordingly becomes perforated when the ridged seam is constructed and laid flat, especially at the intersection between creases, where the longitudinal body scoring intersects with the transverse ridged-seam base line on the upper edge of the blank. The contents can then penetrate into the laminate while the container is being folded up and laid flat, contaminating both the inside of the container and the contents, which will no longer keep very long.

SUMMARY OF THE INVENTION

The object of the present invention is to improve a gable-topped container of the aforesaid type to prevent ridged-seam fracture in the triangular folding tabs that are wrapped around the narrow side of the container with the ridged seam on them and to suppress perforations at the crease intersections.

This object is attained in accordance with the invention in that the container, while still in the erected state, has at least one auxiliary score (31–34, 36–39, or 45–47) for at least each pair of vertical body scores (12), at least one of which is in the vicinity of each triangular folding tab, in the vicinity (9) of the gable and out of alignment with the body score, whereby the auxiliary scores are each positioned on mutually opposing sides of the folding tabs. It has also been demonstrated that positioning the auxiliary scores on diagonally opposing sides in relation to the folding tabs will be sufficient to ensure that the auxiliary scores will come to rest both above and below the wraped ridged seam. To optimize the intended results it is also possible to provide the gable area of the container with at least one auxiliary score out of alignment with the body score. The body scores (12), however, do extend into the vicinity (9) of the gable.

The theory behind the invention can be embodied in many ways in addition to the aforesaid approaches in relation to the position of the auxiliary scores depending on the type of laminate and container. Thus, the auxiliary scores (31–34) can either parallel the geometrical projection (27–30) of the body score or (36–39) slant toward the elongation from the upper corners (41–44) of the body. The position of the auxiliary scores in relation to the body scores and to the central axis of the blank can also vary. Thus they may be oriented either toward the central axis or to a particular edge of the blank, depending on how the results contribute to attaining the object of the invention. It will also be an advantage in particular cases for the auxiliary scores to extend in pairs to the right and to the left from the corners of the body and in relation to the central axis of the blank. Especially satisfactory results in preventing ridged-seam fracture and upthrusts in the vicinity of the crease intersections will be obtained when the auxiliary scores (27–30, 36–39, or 45–47) are 3 to 9 and preferably 6 times the thickness of the laminate (1) away from the geometrical projection (24–30) of the body scores (12). Satisfactory results will also be obtained when the auxiliary scores that extend from the corners (41–44) of the body end 5 to 15 mm away from the base line (23) of the ridged seam. Good results, however, can also be obtained even if the auxiliary scores (47) extend from corners (41–44) of the body to the base line (23) of the ridged seam. The auxiliary scores can alternatively extend from the corners of the body to the edges of the blank, in which case, however, it is recommended that the base line of the ridge seam be interrupted in the vicinity of the auxiliary scores.

The use of auxiliary scores instead of continuous body scores ensures preservation of the ridged-seam seal in its original state in the manufacture and sealing of thick-walled containers. It makes no difference whether the container is made directly from a blank (7) or from an intermediate product, the wrap (26). Ridged-seam fractures of the type prevailing in the prior art will now be avoided, and containers that must be made out of relatively thick laminates can be employed for long-term storage because no moisture will be able to penetrate through a fracture. Another advantage is that, since the auxiliary scoring does not coincide with the folding and prefolding lines, the inner layer of the laminate will not upthrust to the same extent at the crease intersection when the material is folded or prefolded in the folding-box gluing machine (when the wrap is established) and will accordingly not be sharp when the wrap is flattened out because the wrap will be flattened along the line of fold and not along the auxiliary scoring. This will prevent the inner layer of polyethylene from getting perforated by the upthrust aluminum foil while the container is being prefolded and laid flat again for example and maintain the desired tightness on the part of the coating.

In manufacturing the container a method is preferably employed wherein the non-continuous body lines in the vicinity of the gable are produced and hence prefolded in the form of creases in a process of free folding while the wrap is constructed, by wrapping and folding each adjacent blank, for which purpose the wrap is, when constructed, moved toward the longitudinal axes of the blanks, whereby the floor of each wrap is downstream in the direction of travel. This method will ensure that the base is flex-leveled as a result of the free folding, without, that is, preliminary scoring during the folding and unfolding, so that the base will separate and become weak.

BRIEF DESCRIPTION OF THE DRAWINGS

Some preferred embodiments of the invention will now be specified with reference to the attached drawings, wherein.

DETAILED DESCRIPTION OF THE PREFERRED EMBODIMENTS

Figure 1:
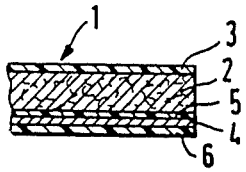
FIG. 1 is a section through the laminate of which the container is made.

FIG. 1 is a section through a packaging material or laminate 1, with its base 2, which can consist for example of two or more layers of cardboard or expanded polystyrene, coated on its upper surface, which will be the outer surface of the container, with a layer 3 of polyethylene. A sheet 4 of aluminum foil is laminated by means of a thin layer 5 of polyethylene to the lower surface of the material, which will face toward the inside of the container. Laminated to the aluminum foil is a thick sheet 6 of polyethylene which will constitute the actual inner surface of the container and come into direct contact with its contents. Other combinations of materials are of course also conceivable and actually employed for laminate 1. Base 2 for example can have a different structure and, if the container is to be employed as a milk carton for instance, aluminum foil 4 and its polyethylene bond 5 can be eliminated.

Figure 2:
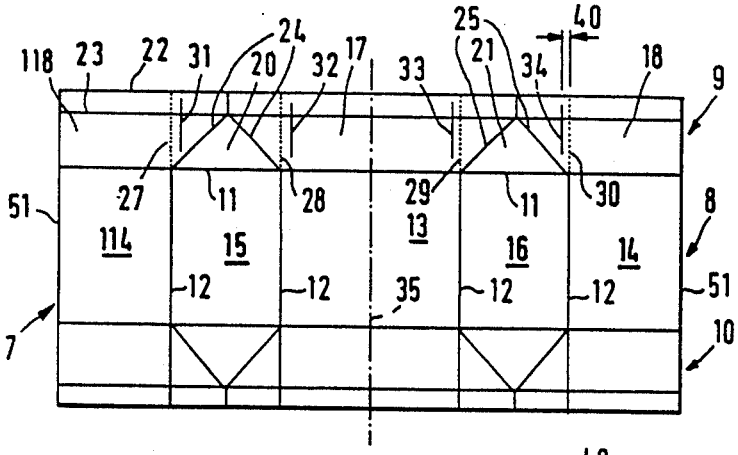
FIG. 2 illustrates a flat blank with parallel auxiliary scores.

The blank 7 illustrated in FIG. 2 is made out of composite 1. The essentially known blank 7 consists of a middle part, the body 8, of an upper part, the head 9, and of a lower part, the floor 10. Body 8 is demarcated by horizontal and vertical body scores 11 and 12, establishing a front 13, a rear 14 and 114, and sides 15 and 16.

Head 9 has gable areas 17, 18, and 118 and triangular folding tabs 20 and 21. At the top of head 9 the base line 23 for a ridged seam extends parallel with and at a slight distance from the upper edge 22 of the blank. Ridged-seam base line 23 also extends through the intersections of the scores 24 and 25 that demarcate triangular folding tabs 20 and 21. The geometric projections of the vertical edges or scores 12 in body 8 represented by the dotted lines at head 9 are not stamped into the blank but will later be freely folded into folds 27 to 30 when the container or container wrap 26 (FIG. 6) is created. There are parallel auxiliary scores 31 to 34 in the blank not very far from folds 27 to 30. The auxiliary scores 31 to 34 in the embodiment illustrated in FIG. 1 have been creased into the blank between body scores 12 and the mathematical central axis 35 of the blank.

Figure 3:
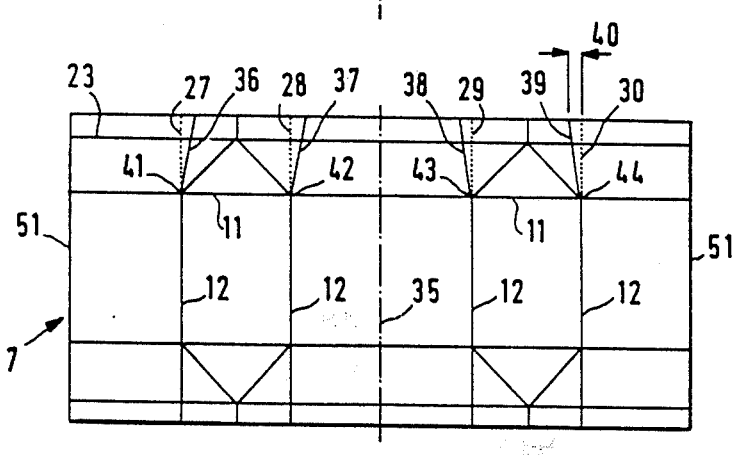
FIG. 3 illustrates a flat blank with auxiliary scores that slant toward its central axis.

FIG. 3 illustrates a blank essentially similar to the one illustrated in FIG. 2, the only difference being that auxiliary scores 36 to 39 are not parallel but slanted. Auxiliary scores 36 to 39 extend from the intersections of horizontal and vertical body scores 11 and 12, which will constitute the upper corners 41 to 44 of the finished container. The auxiliary scores slope in such a way that their upper ends are located on the upper edge 22 of the blank a distance 40 away from folds 27 to 30. Thus, auxiliary scores 36 to 39 slant toward the central axis 35 of the blank.

Figure 4:
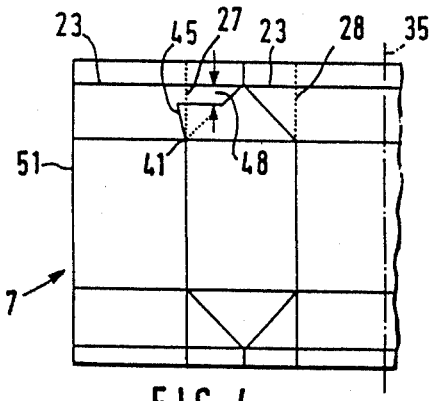
FIG. 4 illustrates part of a blank with auxiliary scores interrupted in the vicinity of the crease intersection.
Figure 5:
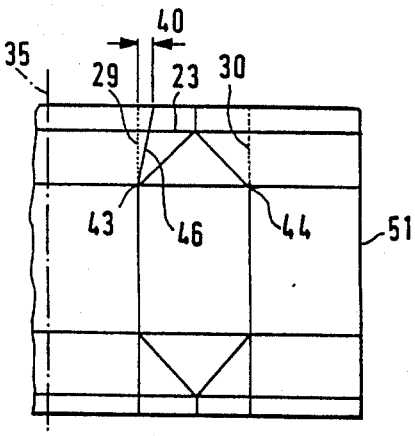
FIGS. 5 and 16 illustrates part of a blank with auxiliary scores that slant out from the central axis of the blank.

FIGS. 4 and 5 illustrate other versions 45 to 47 of the auxiliary scores. Scores 45 to 47 extend from basically the same upper corners 41 to 44 of the container but now slant away from the central axis 35 of the blank. The ends of the scores are the same distance 40 away from vertical body scores 12 on the upper edge 22 of the blank, but the auxiliary scores now slant up and away from central axis 35. The blank illustrated in FIG. 4 also differs in that auxiliary score 45 ends a distance 48 in front of ridged-seam base line 23. The auxiliary score 46 illustrated on the left in FIG. 5, on the other hand, again extends all the way to the upper edge 22 of the blank, with base line 23 interrupted in the vicinity of fold 29 and of auxiliary score 46.

Figure 6:
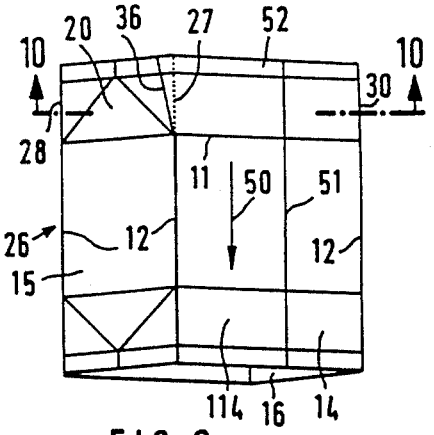
FIG. 6 illustrates a wrap created from one of the blanks illustrated in FIGS. 2 through 5.

FIG. 6 illustrates a container wrap 26 produced in a folding-box gluing machine or filling machine from a blank 7 like those illustrated in FIGS. 2 through 7. The wrap is produced by feeding a blank 7 in the direction of travel (base downstream) indicated by arrow 50 through one of the aforesaid machines. The various areas 14, 114, 15, and 16 of the blank, which will constitute the rear and the sides of the container, are folded up 180° out of the flat blank one after another until each rests flat against its neighbor. The areas are then extended flat again into their original state. This process is "prefolding." The fold 27 (mathematical projection of vertical body score 12) is freely folded during the process because the dotted line is not scored.

Since, however, the adjacent auxiliary score 36 does act to some extent as a guide in establishing fold 27, the fold will assume a prescribed orientation. Since the base 2 of the laminate is separated in the vicinity of head 9 (cf. FIG. 10) by the prefolding process, laminate 1 will become more resilient and flexible, and will not fracture in the vicinity of the ridged seam (cf. FIG. 14) when triangular folding tabs 20 and 21 are wrapped down. Subsequent to prefolding, once the individual areas of the blank have been at least to some extent flattened out again that is, the edges of the eventual longitudinal seam 51 are made adhesive and the halves 14 and 114 of the rear of the body sealed together. These processes—prefolding, reflattening, and final reconstitution—can be considered a form of flex-leveling, at least with respect to folds 27 to 30, that separates the various layers of base 2 and provides ridged seam 52 with enough flexibility to prevent fracture when triangular folding tabs 20 and 21 are wrapped down.

Figure 7:
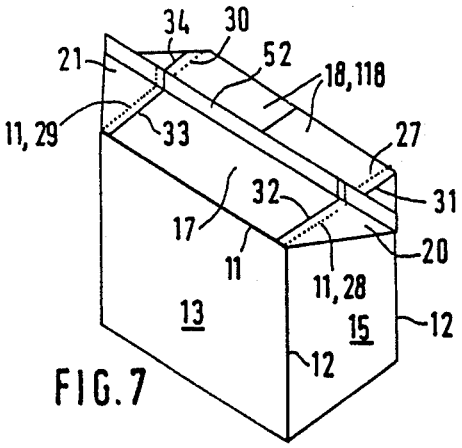
FIG. 7 is a perspective view of a gable-topped container that has been manufactured from the blank illustrated in FIG. 2 and just sealed.

The perspective view in FIG. 7 illustrates the orientation of parallel auxiliary scores 31 to 34 in relation to horizontal body scores 11 and folds 27 to 30. At this stage triangular folding tabs 20 and 21 and ridged seam 52 have not as yet been wrapped down, the stage illustrated in FIGS. 8 and 9.

Figure 8:
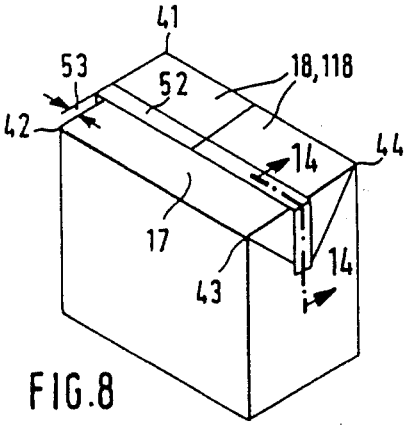
FIG. 8 is a perspective view of the gable-topped container illustrated in FIG. 7 with the folding tabs wrapped down and a lateral seam at the top.
Figure 9:
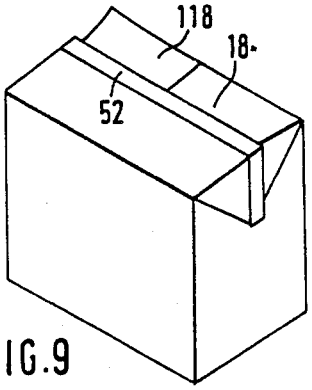
FIG. 9 is a perspective view like FIG. 9 but with the lateral seam partly covered by the ridged seam.

The only difference between FIGS. 8 and 9 is that ridged seam 52 is folded to the left in the former and to the right in the latter, a choice dictated by the design of the particular filling machine employed. The gable areas 17 in FIG. 8 and 118 in FIG. 9 must be a double dimension 53 smaller to prevent excess tension in the particular upper sealing layer of ridged seam 52.

Figure 10:
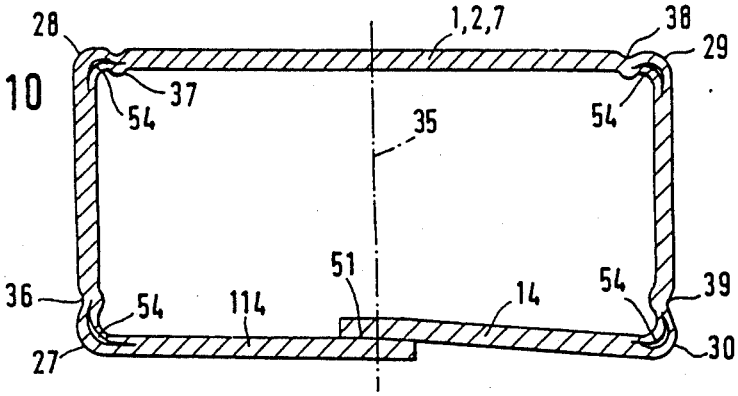
FIG. 10 is a transverse section through the gable along line 10 in FIG. 6, FIGS. 11 and 12 are longitudinal sections through a ridged seam and through wrapped-down folding tabs in the prior art, illustrating the evolution of ridged-seam fracture.

FIG. 10 is a section through the wrap 26 illustrated in FIG. 6. The separations 54 in laminate base 2 will be obvious. Also apparent is the location of the various auxiliary scores 36 to 39 for example in the folded-together state. Auxiliary scores 31 to 34 would be similarly located.

Figure 11:
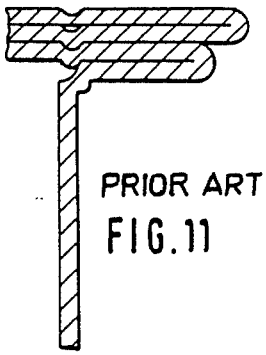
PRIOR ART FIG. 11
Figure 12:
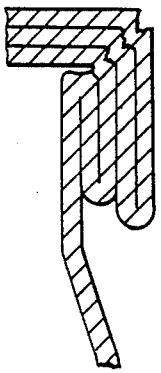
PRIOR ART FIG. 12

FIGS. 11 and 12 show how the scores in the individual layers are directly above one another in the prior art and why the tension in the outer layer becomes so high when the layers are wrapped down that the outer layer fractures.

Figure 13:
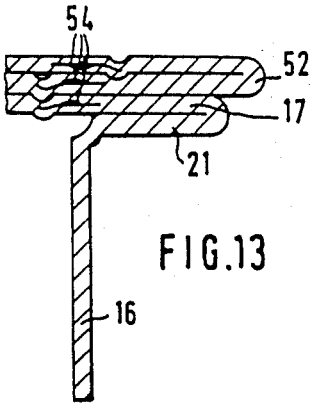
FIGS. 13 and 14 are longitudinal sections along the line 14 in FIG. 8 through a ridged seam and through wrapped-down folding tabs in accordance with the invention, illustrating the absence of ridged-seam fracture.
Figure 14:
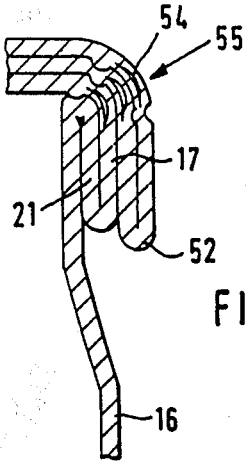

As will be evident from FIGS. 13 and 14, however, the auxiliary scores are not directly above one another in accordance with the invention, and the flex-leveling will also separate certain areas in the layers of the base such that, augmented by the now longer wrap-down radii 55, the tension will be distributed throughout all the layers in the laminate and the outer layers will not fracture.

Figure 15:
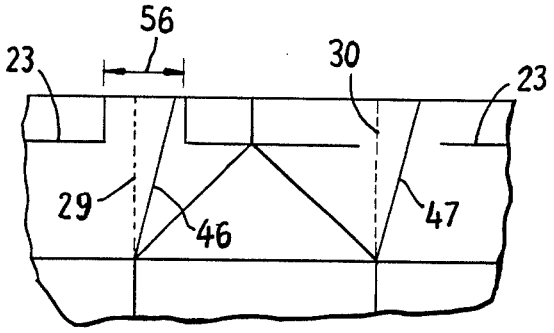
FIG. 15 is a detail of the gable area of a blank.
Figure 16:
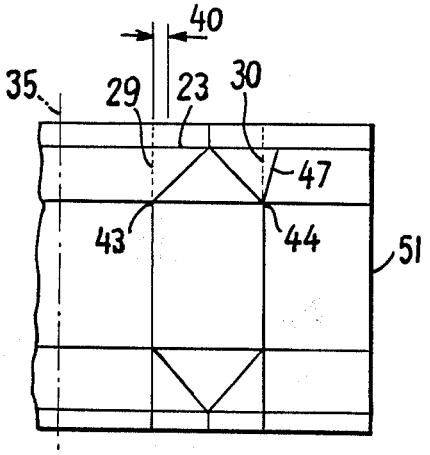

FIG. 15 illustrates another embodiment. It represents part of a blank employing the auxiliary scores illustrated in FIG. 5. The base line 23 of the ridges seam is interrupted in the vicinity of auxiliary scores 46 and 47, with the length 56 of interruption being approximately 6 to 10 mm for instance. The interruption ensures definite, uniform, that is, deformation relationships along auxiliary scores 46 and 47 that are not destroyed at any point by a transverse score.

It is understood that the specification and examples are illustrative but not limitative of the present invention and that other embodiments within the spirit and scope of the invention will suggest themselves to those skilled in the art.

What is claimed is:

1. A multilayer plastic laminate blank for folding into a parallelepipedal container having a top, a bottom and side walls, comprising a rectangular body with a top edge disposed at the top of the container when folded, a bottom edge opposite the top edge and disposed at the bottom of the container when folded, a first score line spaced apart from and parallel to the top edge and corresponding to an edge of the top of the container when folded, a second score line disposed between the first score line and the bottom edge and parallel thereto and corresponding to an edge of the bottom of the container when folded;

two pairs of spaced apart third score lines extending between the first and second score lines and perpendicular thereto, each pair of third score lines corresponding to edges of the side walls of the container when folded and each pair of the two pair of third score lines having a collinear imaginary extension above the first score line to define two given areas bounded by the imaginary extensions, the first score line and the top edge;

a fourth score line disposed between the first score line and the top edge and parallel thereto for forming a seam closure at the top of the container;

a fifth score line disposed between the second score line and the top edge and parallel thereto for forming a seam closure at the bottom of the container;

triangular tab forming score lines disposed in the two given areas;

two pair of auxiliary score lines associated with the two pair of third score lines and solely disposed above the first score line, wherein each pair of auxiliary score lines is parallel to each other and offset from said imaginary extensions of the third score lines such that one of the auxiliary score lines of each pair is within one of the given areas and the other of the auxiliary score lines of each pair is outside the given areas.

2. The blank according to claim 1, wherein the auxiliary score are parallel to said imaginary extensions.

3. The blank according to claim 1, wherein the auxiliary scores slant upwardly from the first score line.

4. The blank according to claim 1, wherein the offset of the auxiliary score is 3 to 9 times the thickness of the blank.

5. The blank according to claim 1, wherein the auxiliary score lines terminate at the fifth score line.

6. The blank according to claim 1, wherein the auxiliary score lines terminate short of the fifth score line.

7. A parallelepipedal container having a top, a bottom and side walls and formed from a multilayer plastic laminate blank having a rectangular body with a top edge disposed at the top of the container, a bottom edge opposite the top edge and disposed at the bottom of the container, a first score line spaced apart from and parallel to the top edge and corresponding to an edge of the top of the container, a second score line disposed between the first score line and the bottom edge and parallel thereto and corresponding to an edge of the bottom of the container;

two pairs of spaced apart third score lines extending between the first and second score lines and perpendicular thereto, each pair of third score lines corresponding to edges of the sidewalls of the container and each pair of the two pair of the third score lines having a collinear imaginary extension above the first score line to define two given areas bounded by the imaginary extensions, the first score line and the top edge;

a fourth score line disposed between the first score line and the top edge and parallel thereto for forming a seam closure at the top of the container;

a fifth score line disposed between the second score line and the bottom edge and parallel thereto for forming a sean closure at the bottom of the container;

triangular tab forming score lines disposed in the two given areas;

two pair of auxiliary score lines associated with the two pair of third score lines and solely disposed above the first score line, wherein each pair of auxiliary score lines is parallel to each other and offset from said imaginary extensions of the third score lines such that one of the auxiliary score lines of each pair is within one of the given areas and the other of the auxiliary score lines of each pair is outside the given areas;

whereby each tab is capable of being wrapped out and around a straight buckling edge formed by the auxiliary scores and onto the side walls of the container.

8. A method of manufacturing a parallelepipedal bulk-material container having a top, side walls and a bottom, comprising: forming a multilayer plastic laminate blank comprising a rectangular body with a top edge disposed at the top of the container when folded, a bottom edge opposite the top edge and disposed at the bottom of the container when folded, a first score line spaced apart from and parallel to the top edge and corresponding to an edge of the top of the container when folded, a second score line disposed between the first score line and the bottom edge and parallel thereto and corresponding to an edge of the bottom of the container when folded;

forming two pairs of spaced apart third score lines extending between the first and second score lines and perpendicular thereto, each pair of third score lines corresponding to edges of the side walls of the container when folded and each pair of the two pair of third score lines having a collinear imaginary extension above the first score line to define two given areas bounded by the imaginary extensions, the first score line and the top edge, forming a fourth score line disposed between the first score line and the top edge and parallel thereto for forming a seam closure at the top of the container, forming a fifth score line disposed between the second score line and the bottom edge and parallel thereto for forming a seam closure at the bottom of the container, forming triangular tab forming score lines disposed in the two given areas, forming two pair of auxiliary score lines associated with the two pair of third score lines and solely disposed above the first score line, wherein each pair of auxiliary score lines is parallel to each other and offset from said imaginary extensions of the third score lines such that one of the auxiliary score lines of each pair is within one of the two given areas and the other of the auxiliary score lines of each pair is outside the given areas; and folding the blank into the container.

9. The method according to claim 8, wherein the step of folding includes repeatedly folding the blank along the two pairs of third score lines.

* * * * *

UNITED STATES PATENT AND TRADEMARK OFFICE

CERTIFICATE OF CORRECTION

PATENT NO. : 4,795,086

DATED : January 3, 1989

INVENTOR(S) : Jürgen Färber

It is certified that error appears in the above-identified patent and that said Letters Patent is hereby corrected as shown below:

| | |
|---|---|
| Col. 6, line 24 | Delete "the top edge" and substitute --the bottom edge-- |

Signed and Sealed this

Thirteenth Day of February, 1990

*Attest:*

JEFFREY M. SAMUELS

*Attesting Officer*

*Acting Commissioner of Patents and Trademarks*